US007414367B2

(12) United States Patent
Baier et al.

(10) Patent No.: US 7,414,367 B2
(45) Date of Patent: Aug. 19, 2008

(54) MERCURY FREE HIGH-PRESSURE METAL HALIDE DISCHARGE LAMP

(75) Inventors: Johannes Baier, Würselen (DE); Rainer Hilbig, Aachen (DE); Achim Gerhard Rolf Körber, Kerkrade (NL); Robert Peter Scholl, Roetgen (DE); Matthias Born, Geldern (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/552,811

(22) PCT Filed: Apr. 2, 2004

(86) PCT No.: PCT/IB2004/050387

§ 371 (c)(1),
(2), (4) Date: Oct. 11, 2005

(87) PCT Pub. No.: WO2004/093125

PCT Pub. Date: Oct. 28, 2004

(65) Prior Publication Data

US 2006/0208642 A1 Sep. 21, 2006

(30) Foreign Application Priority Data

Apr. 16, 2003 (EP) ..... 03101034

(51) Int. Cl.
*H01J 61/12* (2006.01)

(52) U.S. Cl. ..... 313/637; 313/638; 313/640

(58) Field of Classification Search ..... 313/637, 313/638, 640

See application file for complete search history.

(56) References Cited

U.S. PATENT DOCUMENTS

| | | | | |
|---|---|---|---|---|
| 3,484,640 | A | 12/1969 | Johnson | |
| 4,001,626 | A | 1/1977 | Drop et al. | |
| 4,027,190 | A | 5/1977 | Shintani et al. | |
| 4,360,756 | A | 11/1982 | Spencer et al. | |
| 4,360,758 | A | 11/1982 | Thornton, Jr. et al. | |
| 4,387,319 | A | 6/1983 | White et al. | |
| 4,742,268 | A * | 5/1988 | Caruso et al. | 313/620 |
| 4,766,348 | A * | 8/1988 | English et al. | 313/631 |
| 4,801,846 | A | 1/1989 | Kramer et al. | |
| 4,941,743 | A * | 7/1990 | Hadeishi et al. | 356/311 |
| 4,992,700 | A | 2/1991 | Lake | |
| 5,013,968 | A * | 5/1991 | Russell et al. | 313/641 |
| 5,481,159 | A | 1/1996 | Hiramoto et al. | |

(Continued)

FOREIGN PATENT DOCUMENTS

DE 676726 C1 6/1939

(Continued)

OTHER PUBLICATIONS

ISR, Written Opinion of the International Searching Authoritty PCT/IB2004/050387.

*Primary Examiner*—Toan Ton
*Assistant Examiner*—Hana A Sanei

(57) ABSTRACT

A high-pressure metal halide discharge lamp which comprises, as filling, only zinc, a halogen and a noble gas. In order to improve the color rendering index, a calcium halide may be added to the lamp filling. The coupling-in of energy preferably takes place without electrodes in the radio-frequency range or in the microwave range, but may also be carried out by means of metal electrodes.

7 Claims, 2 Drawing Sheets

U.S. PATENT DOCUMENTS

Figure 1:
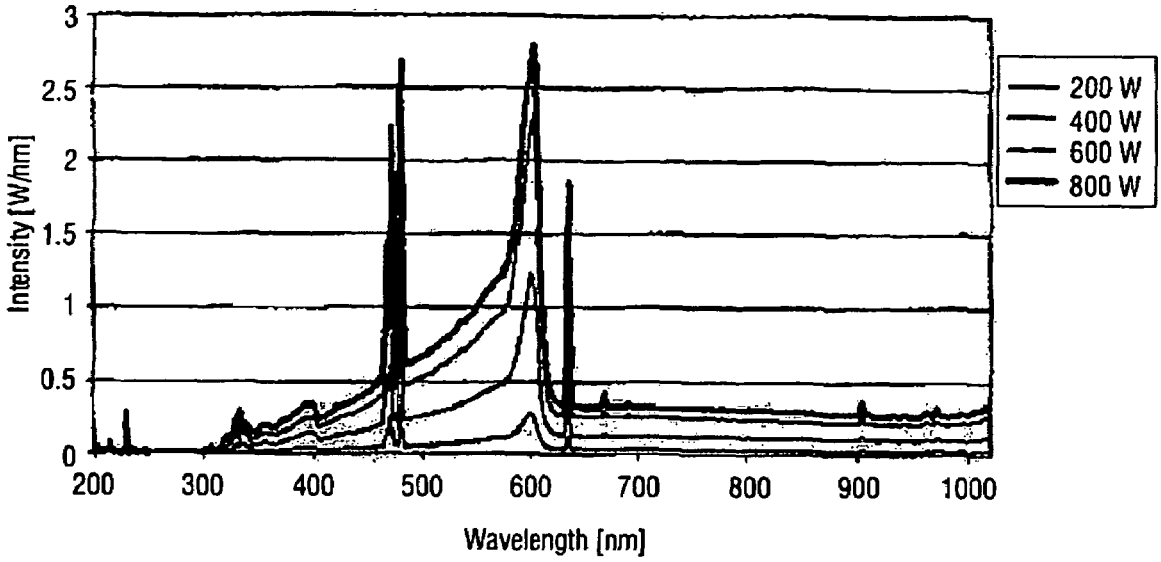

| | | | | |
|---|---|---|---|---|
| 6,054,811 | A | 4/2000 | Genz et al. | |
| 6,137,230 | A * | 10/2000 | Born et al. | 313/638 |
| 6,483,241 | B1 * | 11/2002 | Stockwald | 313/638 |
| 2003/0141818 | A1 * | 7/2003 | Kelly | 313/638 |

FOREIGN PATENT DOCUMENTS

| | | | |
|---|---|---|---|
| EP | 1172840 | A2 | 1/2002 |
| GB | 1280370 | | 3/1970 |
| JP | 55010764 | A | 1/1980 |
| WO | 9905699 | A1 | 2/1999 |
| WO | 9953522 | A1 | 10/1999 |
| WO | 9965052 | A1 | 12/1999 |

* cited by examiner

MERCURY FREE HIGH-PRESSURE METAL HALIDE DISCHARGE LAMP

The subject of the invention is a high-pressure metal halide discharge lamp which comprises, as filling, besides a noble gas, only zinc and a halogen.

Zinc as a constituent of the filling of metal halide discharge lamps has already been mentioned in a number of patents. However, in all these cases zinc only plays the part of a buffer gas, that is to say it is used to increase the tube voltage of the lamp or to buffer excess halogen. On the other hand, further metal halides are added as light-generating substances.

For instance, a metal halide discharge lamp which comprises, as filling, besides mercury, also sodium halide and a thallium halide is known for example from the international patent application WO 99/53522. The filling may also comprise calcium ions.

A mercury-free metal halide discharge lamp which comprises, besides a noble gas, also a filling containing sodium iodide is known from the international patent application WO 99/05699. Zinc ions may also be present in the discharge space.

It is therefore an object to develop high-pressure metal halide discharge lamps which have a higher power and improved use properties, said discharge lamps having a color point in the vicinity of the black body curve, that is to say emitting white light. In addition, the color point should change only slightly in the event of a change in power, that is to say the discharges should be easily dimmable. Furthermore, it is expected that the filling substances do not react with the customary wall materials of the lamp tube, whereby a very long service life of the discharge lamps can be achieved. Finally, modem high-pressure metal halide discharge lamps should be very environmentally friendly, that is to say should not comprise any mercury.

This object is achieved by a high-pressure metal halide discharge lamp which comprises, as filling, only zinc, a halogen and a noble gas. A discharge lamp which comprises, as filling, only zinc, iodine and a noble gas is particularly preferred.

In the discharge lamp according to the invention, the overall amount of the atomic halogen is between 1-30 μmole/cm$^3$, while the overall amount of zinc is >1 μmole/cm$^3$ and the zinc/atomic halogen molar ratio is >0.5. A discharge lamp in which the zinc/atomic halogen molar ratio is >1 is very particularly preferred. Such discharge lamps may be operated without electrodes, with the coupling-in of energy taking place in the radio-frequency range (0.1-1000 Mhz) or in the microwave range (>1000 MHz). However, it is also possible for the coupling-in of energy to be carried out by means of metal electrodes.

If zinc iodide is filled into a high-pressure metal halide discharge lamp, there can be seen in the spectrum mainly the lines of the zinc (472, 481 and 636 nm) and a molecule continuum (B-X band system of the zinc iodide) with a maximum (="satellite") at 602 nm, as shown in FIG. 1 (example of embodiment 1).

Figure 2:
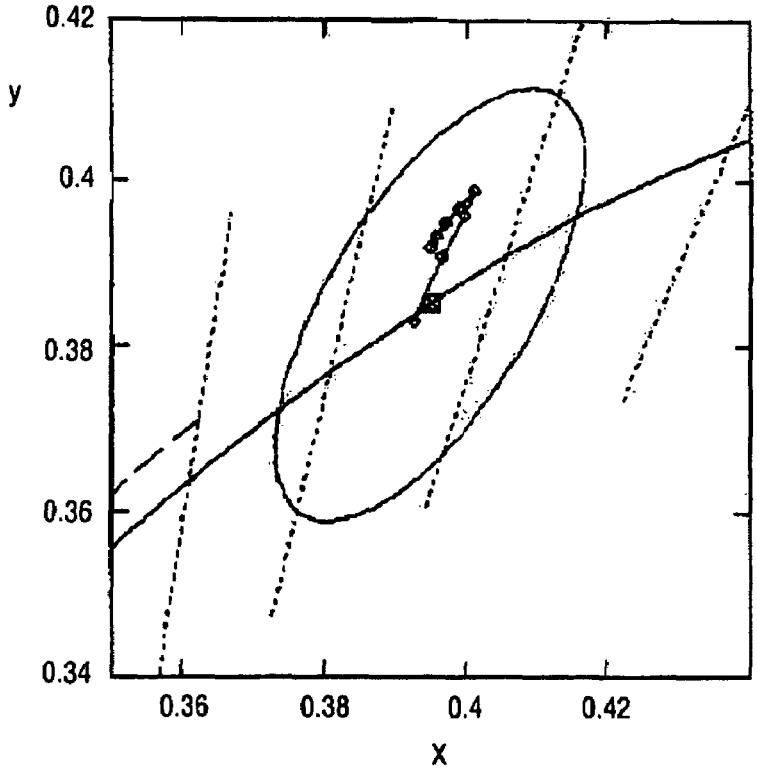

FIG. 1 shows the spectra of a microwave lamp (v=2.45 GHz). The discharge vessel is a quartz sphere having an internal diameter of 32 mm (i.e. V=17 cm$^3$), has a wall thickness of 2 mm and is filled with 4.3 mg of zinc, 20 mg of zinc iodide and argon at a cold pressure of 100 mbar. The discharge is extremely efficient (η=120 lm/W at an input power of 600 W) and emits white light with a constant, power-independent color point, i.e. in the x-y diagram the color point lies considerably within a MacAdam ellipse of 10 SDCM ("Standard Deviation of Color Matching") around Tc=3700 K on the black body curve (cf. FIG. 2).

The general color rendering index $Ra_8$=67 of the lamp according to the invention in example of embodiment 1 is too low for many applications but may be considerably improved by adding a red emitter (for example calcium iodide). This method is known for example from the U.S. Pat. Nos. 4,027,190, 4,360,758, 4,742,268, 4,801,846, the international application WO 99/65052 and the above mentioned international application WO 99/53522. The calcium iodide emits two band systems (A-X: around 640 nm, B-X: around 630 nm, cf. FIG. 3=example of embodiment 2) which lead to a decrease in the color temperature Tc and an increase in the color rendering index $Ra_8$.

Figure 3:
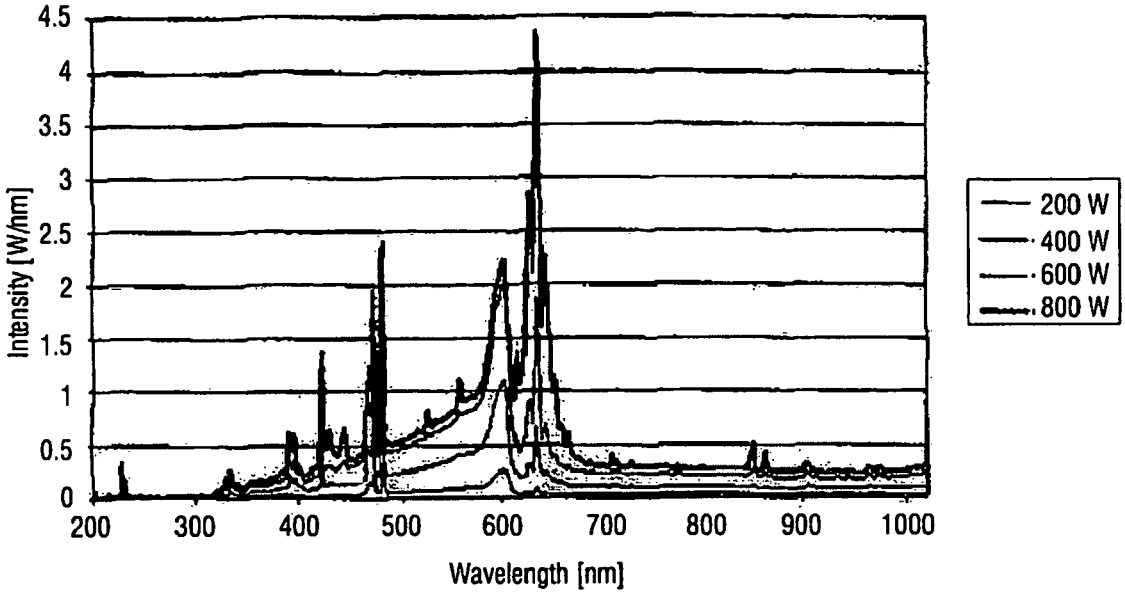
Figure 4:
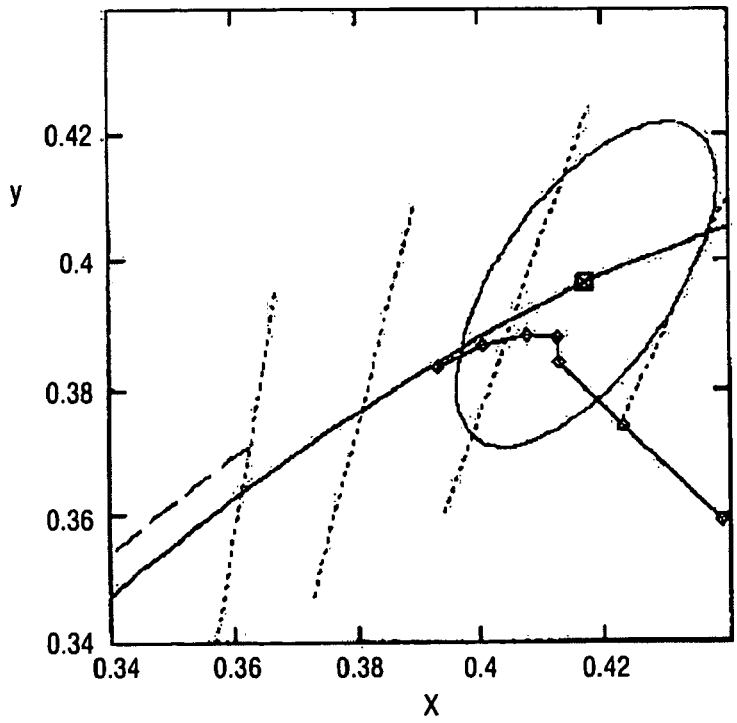

FIG. 3 thus shows the spectra of a microwave lamp (v=2.45 GHz) according to the invention. The discharge vessel is a quartz sphere having an internal diameter of 32 mm (i.e. a volume of 17 cm$^3$), has a wall thickness of 2 mm and is filled with 4.6 mg of zinc, 20 mg of zinc iodide, 1.2 mg of calcium iodide and argon at a cold pressure of 100 mbar. This discharge exhibits very good photometric data (η=112 lm/Watt at an input power of 660 Watt, Tc=3300 K, $Ra_8$=79). The emitted light is white, i.e. for average input powers the color point in the x-y diagram lies within a MacAdam ellipse of 10 SDCM around Tc=3300 K on the black body curve, as shown in FIG. 4. However, at very high input powers too much calcium iodide may vaporize, so that the color point migrates from the black body curve in the red direction.

It is therefore expedient for the high-pressure metal halide discharge lamp according to the invention to comprise a calcium halide in an overall amount of calcium of at least 1 μmole/cm$^3$.

The discharge lamps according to the invention produced in accordance with examples of embodiments 1 and 2 each comprise about 7 μmole/cm$^3$ of zinc and iodine. An experiment with twice the filling amount resulted in an approximately 10% lower efficiency, and this can probably be explained by self-absorption of the zinc iodine radiation in the outer area of the discharge. This means that the overall amounts of zinc and iodine in the gas phase must lie approximately in the range from 1 to 30 μmole/cm$^3$. The partial pressure of zinc iodide in the emitting inner area of the discharge is proportional to the product of the overall pressure ΣpZn of the Zn and the overall pressure ΣpI of the iodine in the discharge, i.e., a desired partial pressure of zinc iodide may be realized with different Zn/I molar ratios. High iodine pressure are undesirable since they may lead to quartz transport (i.e., the wall becomes milky) and ignition problems on account of the formation of HI with hydrogen from impurities. It is therefore favorable to select the Zn/I molar ratio to be as high as possible, i.e to meter zinc in excess (Zn/I>1), inorder to keep the iodine pressure as low as possible. If, as shown in example of embodiment 2, $CaI_2$ is added, then for a coldest spot temperature of around 1200 K and an overall iodine pressure ΣpI of around 1.5 bar an overall calcium pressure ΣpCa ≈0.2 mbar is calculated, which corresponds to an overall amount of calcium of 1 nm/cm$^3$. This amount is about the lower limit in order to obtain a noticeable effect in the shifting of the color point.

The discharge lamp according to the invention has a lamp tube that is transparent to UV light. It is expediently made of quartz, aluminun oxide and yttrium aluminum garnet.

The high-pressure metal halide discharge lamps according to the invention, as can be obtained in accordance with examples of embodiments 1 and 2, exhibit a high light intensity (>120 lm/W) and emit white light which lies in the vicinity of the color point of the black body curve (<10

SCDM). In addition, the discharges are easily dimmable, i.e. the color point varies only very lightly in the event of changes in power. The filling substances such as zinc iodide do not react, or in the case of calcium iodide react only slightly, with the customary wall materials, that is to say quartz, polycarbonate, yttrium aluminum garnet and similar compounds, resulting in a very long service life. Moreover, the lamp fillings according to the invention are very environmentally friendly since they do not comprise any mercury.

The invention claimed is:

1. A high-pressure metal halide discharge lamp, comprising a filling, wherein the filling includes zinc, a halogen and a rare gas, wherein at least a portion of the zinc and at least a portion of the halogen are present as zinc halogenide, wherein an overall amount of the halogen is between 1 and 30 μmole/$cm^3$, an overall amount of the zinc is more than 1 μmole/$cm^3$, and the zinc/halogen molar ratio is greater than 0.5.

2. The discharge lamp as claimed in claim 1, wherein the halogen is iodine and the zinc halogenide is the zinc iodide.

3. The discharge lamp as claimed in claim 1, wherein the zinc/halogen molar ratio is greater than 1.

4. The discharge lamp as claimed in claim 1, wherein a coupling-in of energy takes place without electrodes in the radio-frequency range (0.1-1000 MHz) or in the microwave range (greater than 1000 MHz).

5. The discharge lamp as claimed in claim 1, wherein a coupling-in of energy takes place by means of metal electrodes.

6. The discharge lamp as claimed in claim 1, wherein the filling further comprises a calcium halide, with an overall amount of calcium being at least 1 μmole/$cm^3$.

7. The discharge lamp as claimed in claim 1, further comprising a lamp tube including quartz, aluminum oxide, or yttrium-aluminum garnet.

* * * * *